US009423225B1

(12) United States Patent
Yoon et al.

(10) Patent No.: US 9,423,225 B1
(45) Date of Patent: Aug. 23, 2016

(54) NON-PYROTECHNIC, NON-LETHAL COMPRESSED GAS DISSEMINATOR

(71) Applicant: U.S. Army Edgewood Chemical and Biological Command, APG, MD (US)

(72) Inventors: Elias W. Yoon, Elkridge, MD (US); Daniel G. Wise, Ellicott City, MD (US); Daniel J. Weber, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/850,433

(22) Filed: Sep. 10, 2015

(51) Int. Cl.
*F42B 12/46* (2006.01)
*F42B 12/50* (2006.01)
*F42B 27/00* (2006.01)

(52) U.S. Cl.
CPC ..... *F42B 12/50* (2013.01); *F42B 27/00* (2013.01)

(58) Field of Classification Search
CPC ..... F42B 12/46; F42B 12/50; F42B 27/00
USPC ..... 102/367, 368
See application file for complete search history.

(56) References Cited

U.S. PATENT DOCUMENTS 3,188,954 A * 6/1965 Roach ..... F42B 12/50 102/369
3,437,245 A * 4/1969 LaCosta ..... F42B 12/50 102/482
3,656,435 A * 4/1972 Barr ..... F42C 14/02 102/368
5,411,225 A * 5/1995 Lannon ..... F42B 6/10 102/505
6,349,650 B1 * 2/2002 Brunn ..... F42B 27/00 102/368
7,975,615 B1 * 7/2011 Apple ..... F42B 5/15 102/512
8,899,156 B1 * 12/2014 Tseng ..... F42B 12/36 102/368
8,904,940 B1 * 12/2014 Pann ..... F42B 27/00 102/368
2006/0233050 A1 * 10/2006 Unsworth ..... A63H 5/04 367/144
2007/0266883 A1 * 11/2007 Law ..... F42B 12/60 102/482
2009/0071459 A1 * 3/2009 Wenaas ..... F41B 11/62 124/71

* cited by examiner

*Primary Examiner* — Gabriel Klein
(74) *Attorney, Agent, or Firm* — Ulysses John Biffoni

(57) ABSTRACT

A non-pyrotechnic disseminator includes a body portion with a cover; a first compartment adjacent to the cover that is configured to hold disseminating materials; a chamber adjacent to the first compartment; a disk within the chamber and adjacent to the first compartment; a flow control device adjacent to the chamber opposite the disk; a second compartment adjacent to the flow control device and including a pin; an actuating mechanism connected to the pin; a third compartment adjacent to the second compartment opposite the flow control device that is configured to hold compressed gas; and a seal separating the second compartment from the third compartment. Actuation of the actuating mechanism causes the pin to break the seal causing release of the compressed gas into the second compartment and through the flow control device in a predetermined delayed timing, and then causing the compressed gas to burst the disk thereby pushing the disseminating materials out of the body portion by rupturing the cover.

8 Claims, 5 Drawing Sheets

NON-PYROTECHNIC, NON-LETHAL COMPRESSED GAS DISSEMINATOR

GOVERNMENT INTEREST

The embodiments described herein may be manufactured, used, and/or licensed by or for the United States Government.

BACKGROUND

1. Technical Field

The embodiments herein generally relate to compressed gas dissemination devices, and more particularly to non-pyrotechnic compressed gas disseminators.

2. Description of the Related Art

The conventional CS (teargas) grenade (M7A3), shown in FIGS. 1A and 1B, relies on a burning pyrotechnic to disseminate 128 g of pelletized CS which results in approximately 45-50 grams of CS dispersed as an aerosol. Pyrotechnic disseminators can burn some of the CS, destroying its active properties, as well as posing a high risk of starting fires. The threat of fire limits the grenade's operational uses to outdoors scenarios under controlled conditions that reduce the risk of fires. Pyrotechnic devices operate over an extended period of time, with total functioning times typically measuring in tens of seconds to minutes.

Bursting type grenades can provide a near instantaneous disseminated cloud. The obsolete ABC-M25A2, shown in FIGS. 2A and 2B, is an example of this type of grenade that uses an explosive detonator to expel the CSI fill (~57 g). A bursting grenade has a reduced risk of fire hazard, but due to its method of operation can cause injury to personnel from flying grenade body shrapnel.

A number of commercial riot control disseminators are available. These devices typically rely on pyrotechnics, explosives, or propellants (gas) to disseminate the riot control agent, and most use pyrotechnic fuze/delay systems. The pyrotechnic devices generally employ double and triple walled configurations to contain the pyrotechnic flame internally and reduce the risk of starting fires.

Furthermore, there are a number of devices that use compressed gas to propel a projectile, although many of these devices are focused on the paintball industry. Some examples of conventional grenade type devices that use compressed gases in their operations are provided below, the complete disclosures of which, in their entireties, are herein incorporated by reference.

U.S. Pat. No. 6,349,650 issued to Brunn et al. for a "Launchable Flameless Expulsion Grenade" uses $CO_2$ to entrain powders in the gas flow, though this device uses pyrotechnics in its fuzing. U.S. Pat. No. 5,996,503 issued to Woodall et al. for a "Reusable Gas-Powered Hand Grenade" is non-pyrotechnic grenade and uses compressed gas to launch small projectiles. U.S. Pat. No. 5,069,134 issued to Pinkney for a "Flameless Expulsion Grenade" uses compressed gas to entrain powder for dissemination, but uses a pyrotechnic fuze. U.S. Pat. No. 3,188,954 issued to Roach et al. for a "Gas Ejection Bomb for Dispersing Solid Particulates" provides an air delivered, fin stabilized bomb that uses compressed gas to entrain powder for dissemination. U.S. Pat. No. 3,402,665 issued to Tarpley, Jr. et al. for a "Non-Pyrotechnic Disseminator" relies on a pyrotechnic fuze. U.S. Pat. No. 4,690,061 issued to Armer, Jr. et al. for a "Landmine for Use in Simulated War Games" employs compressed gas to spray a liquid/slurry marking material. "Paintball Grenade" U.S. Pat. No. 4,944,521 issued to Greeno for a "War Game Marking Grenade" launches a plurality of paintballs propelled by compressed gas. U.S. Pat. No. 5,365,913 issued to Walton for a "Rupture Disk Gas Launcher" is for a compressed gas gun type device for launching larger projectiles.

While the conventional solutions were suitable for the purposes for which they were designed, they generally do not provide a suitable solution for non-pyrotechnic and non-lethal uses, and accordingly there remains a need for a new non-pyrotechnic, non-lethal compressed gas disseminator.

SUMMARY

In view of the foregoing, an embodiment herein provides a non-pyrotechnic disseminator comprising a body portion; a cover on the body portion; a first compartment adjacent to the cover, wherein the first compartment is configured to hold disseminating materials; a chamber adjacent to the first compartment; a disk within the chamber and adjacent to the first compartment; a flow control device adjacent to the chamber; a second compartment adjacent to the flow control device, wherein the second compartment comprises a pin; an actuating mechanism operatively connected to the pin; a third compartment adjacent to the second compartment, wherein the third compartment is configured to hold compressed gas; and a seal separating the chamber from the third compartment. Actuation of the actuating mechanism causes the pin to break the seal causing release of the compressed gas into the second compartment and through the flow control device in a predetermined delayed timing, and causing the compressed gas to burst the disk thereby pushing the disseminating materials out of the body portion by rupturing the cover. The non-pyrotechnic disseminator may further comprise a piston in the first compartment. The piston may comprise holes. The first compartment may further comprise at least one stop configured to retain the piston within the first compartment. The disseminating materials may exit the body portion as an aerosol. The disseminating materials may comprise any of a powder, slurry, and liquid. The non-pyrotechnic disseminator may further comprise a self-righting mechanism operatively connected to the body portion. The compressed gas may comprise carbon dioxide.

Another embodiment provides a grenade comprising a body portion; a plurality of compartments, configured in the body portion, wherein the plurality of compartments are positioned to separately hold disseminating materials and compressed gas; a plurality of components, in the body portion; and an actuating mechanism operatively connected to one of the plurality of components, wherein actuation of the actuating mechanism causes the plurality of components to controllably release the compressed gas through the body portion thereby pushing the disseminating materials out of the body portion. The grenade may further comprise a cover on the body portion, wherein the plurality of compartments comprises a first compartment adjacent to the cover, wherein the first compartment is configured to hold the disseminating materials; a chamber adjacent to the first compartment; a second compartment comprising a pin; and a third compartment adjacent to the second compartment, wherein the third compartment is configured to hold the compressed gas. The plurality of components includes a disk within the chamber and adjacent to the first compartment; a flow control device adjacent to the chamber and the second compartment; and a seal separating the second and third compartments. Actuation of the actuating mechanism causes the pin to break the seal causing release of the compressed gas into the second compartment and through the flow control device in a predetermined delayed timing, and causing the compressed gas to burst the disk thereby pushing the disseminating materials out of the body portion by rupturing the cover. The grenade may further comprise a piston in the first compartment. The piston may comprise holes. The first compartment may further comprise at least one stop configured to retain the piston within the first compartment. The disseminating materials may exit the body portion as an aerosol, and the disseminating materials may comprise any of a powder, slurry, and liquid. The grenade may further comprise a self-righting mechanism operatively connected to the body portion. The compressed gas may comprise carbon dioxide.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1B:
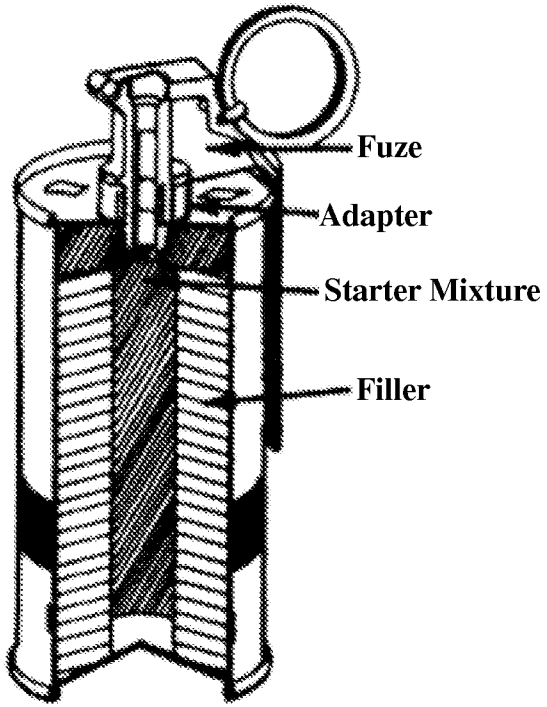
FIG. 1B (Prior Art)
FIG. 1B illustrates a sectional view of the M7A3 CS hand grenade of FIG. 1A.
Figure 1A:
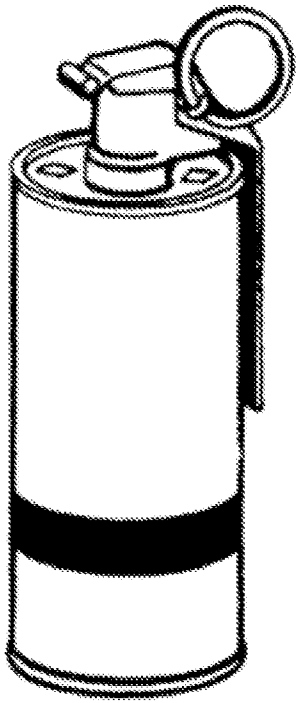
FIG. 1A (Prior Art)
FIG. 1A illustrates a perspective view of a conventional M7A3 CS hand grenade.
Figure 2B:
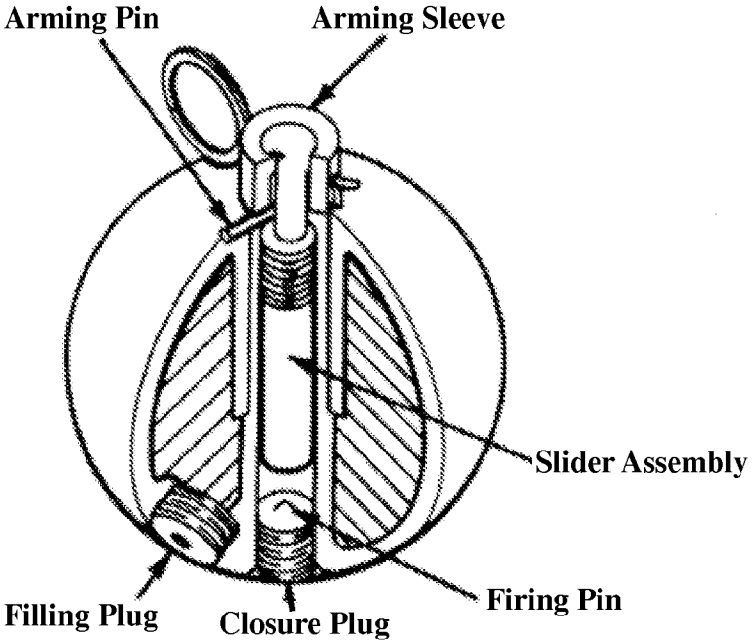
FIG. 2B (Prior Art)
FIG. 2B illustrates a sectional view of the ABC-M25A2 grenade of FIG. 2A.
Figure 2A:
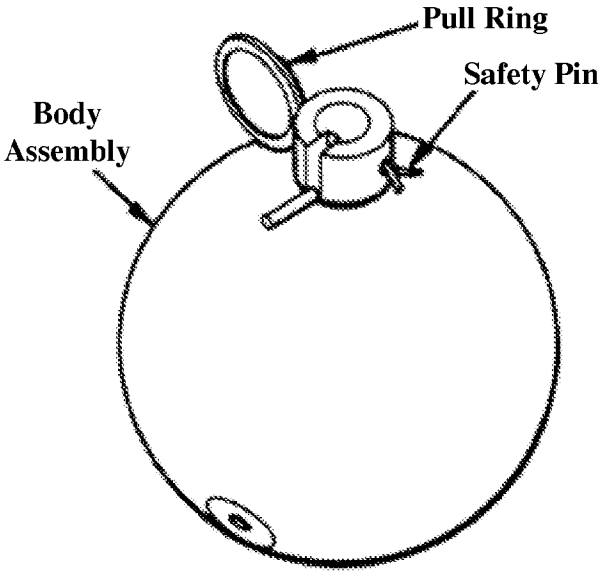
FIG. 2A (Prior Art)
FIG. 2A illustrates a perspective view of a conventional ABC-M25A2 grenade.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a non-pyrotechnic hand grenade size device for the dissemination of powders or other disseminating materials, such as non-lethal riot control agents. The device is applicable to many riot control situations, and is particularly advantageous for use within confined spaces, such as buildings, where the risk of starting a fire is greatest. Being completely non-pyrotechnic allows the device to be classified as non-munitions which significantly reduces handling and storage requirements. Referring now to the drawings, and more particularly to FIGS. 3A through 3D, where similar reference characters denote corresponding features consistently throughout the figures, there are shown preferred embodiments.

A non-pyrotechnic powder disseminator for dispersing non-lethal riot control material rapidly is desirable both from a military and law enforcement perspective. As provided in FIGS. 3A through 3C, the embodiments herein achieve this by providing a non-pyrotechnic disseminator 10 comprising a body portion 12; a cover 15 on the body portion; a first compartment 20 adjacent to the cover 15, wherein the first compartment 20 is configured to hold disseminating materials 80; a chamber 35 adjacent to the first compartment 20; a disk 30 within the chamber 35 and adjacent to the first compartment 20; a flow control device 40 adjacent to the chamber 35; a second compartment 65 adjacent to the flow control device 40, wherein the second compartment 65 comprises a pin 45; an actuating mechanism 50 operatively connected to the pin 45; a third compartment 75 adjacent to the second compartment 65, wherein the third compartment 75 is configured to hold compressed gas 85; and a seal 70 separating the chamber 35 from the third compartment 75. Actuation of the actuating mechanism 50 causes the pin 45 to break the seal 70 causing release of the compressed gas 85 into the second compartment 65 and through the flow control device 40 in a predetermined delayed timing, and causing the compressed gas 85 to burst the disk 30 thereby pushing the disseminating materials 80 out of the body portion 12 by rupturing the cover 15.

The embodiments herein utilize a high pressure compressed gas 85, such as 12 g of carbon dioxide ($CO_2$), to push non-lethal fluidized CS powder 80 out of one end of a cylindrical shaped grenade body 12. The compressed gas 85 is initially contained within the third compartment (e.g., compressed gas compartment) 75 located at the bottom of the grenade body 12. The actuating mechanism 50 comprises a pull ring 52 connected to a safety pin 55, which retains a spring 60 actuated to a stab pin 45. When an operator (not shown) pulls the ring 52 to remove the safety pin 55, the stab pin 45 is released and punctures the seal 70 on the third compartment 75. Then, the high pressure gas pushes back the stab pin 45 and escapes into the second compartment (e.g., delay compartment) 65. The flow control device 40, which may include a properly configured orifice, meters the compressed gas flow into the burst disk chamber 35 providing a three to five second time delay. The pressure in the burst disk chamber 35 increases during the delay time until the burst pressure is reached and the disk 30 ruptures. The piston 25 helps expel all of the powder 80 if the burst disk 30 is considerably smaller in diameter than the grenade body 12. However, if a larger diameter burst disk 30 is used, it may be possible to omit the piston 25 altogether, as described below. In one example embodiment, the disk 30 is 0.75 inches in diameter; although other configurations are possible in accordance with the embodiments herein. A larger diameter burst disk 30; for example, having the same inner diameter as the body 12, may improve dissemination, though a small diameter burst disk 30 may provide better burst control. The size of the burst disk 30 may also depend on whether a piston 25 is used or not. If a piston 25 is used, a smaller diameter burst disk 30 could be used, but if a piston 25 is not used, then a larger burst disk 30 may be required for efficient dissemination of the powder 80. The burst disk 30 also serves as a seal to keep the powder 80 above the burst chamber 35. The high pressure gas 85 then pushes against a piston 25 that separates the first compartment (e.g., payload compartment) 20 and the burst disk chamber 35. The piston 25 is within the first compartment 20.

In one example embodiment, the piston 25 is configured to be two inches in diameter; although other configurations are possible in accordance with the embodiments herein. If a piston 25 is used, the diameter of the piston 25 is preferably substantially equal to the inner diameter of the grenade body 12 for proper dissemination of the powder 80. The piston 25 forces the powder payload 80 against the cover 15 across the top of the grenade body 12 rupturing the cover 15 for an almost instantaneous release of the powder 80. Holes 27 in the piston 25 allow the compressed gas 85 to escape assisting with dissemination by deagglomerating and breaking up the powder 80. The first compartment 20 may include at least one stop 22 at the top of the grenade body 12 to capture and retain the piston 25 within the first compartment 20, and restrain the piston 25 from becoming a projectile and possibly injuring innocent bystanders and non-combatants. Alternatively, the piston 25 can be constructed of a low-density material such as foam, and the stops 22 would not be required.

The non-pyrotechnic powder disseminator 10 eliminates the risk of fire as well as the risk of personnel being burned by a hot grenade body. The disseminator 10 could safely be used in confined spaces and within combustible environments. Furthermore, the disseminator 10 produces an almost instantaneous aerosol cloud 90, similar to that produced by a pyrotechnic/explosive device without the associated injury from shrapnel and ejected parts. Full pyrotechnic devices or devices with small amounts of pyrotechnics in the fuze and delay assemblies require special care for handling and storage. However, a completely non-pyrotechnic disseminator 10, as provided by the embodiments herein, eliminates many of the hazards associated with current inventoried and commercial pyrotechnic and explosive riot control grenades and has fewer restrictions on storage and handling.

Figure 3B:
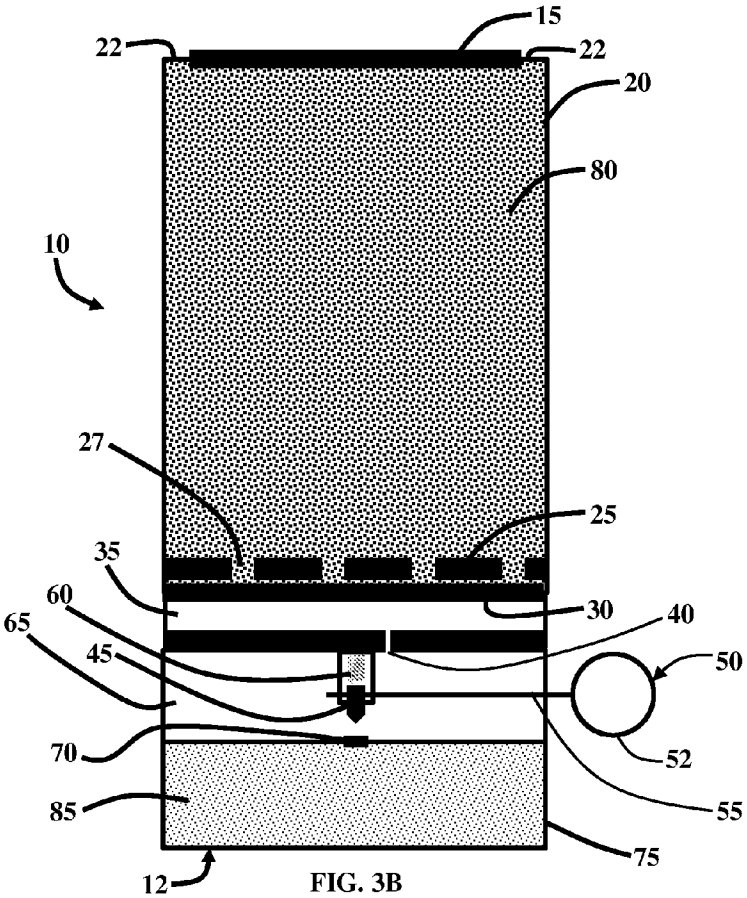
FIG. 3B illustrates a sectional view the compressed gas disseminator of FIG. 3A according to an embodiment herein.
Figure 3A:
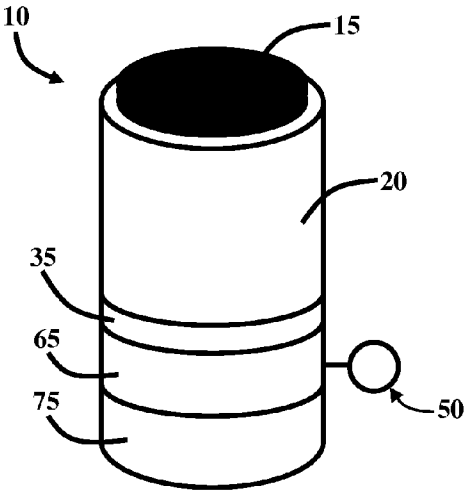
FIG. 3A illustrates a perspective view a compressed gas disseminator according to an embodiment herein.
Figure 3C:
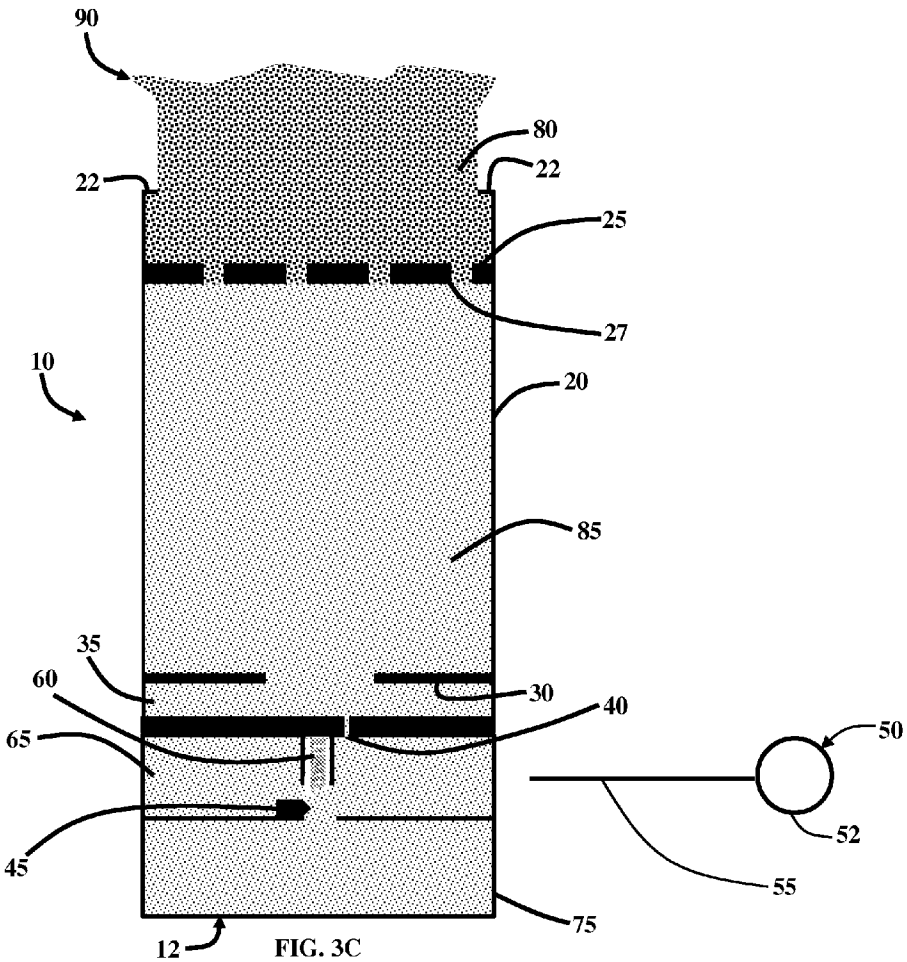
FIG. 3C illustrates a sectional view the compressed gas disseminator of FIG. 3A upon actuation according to an embodiment herein.
Figure 3D:
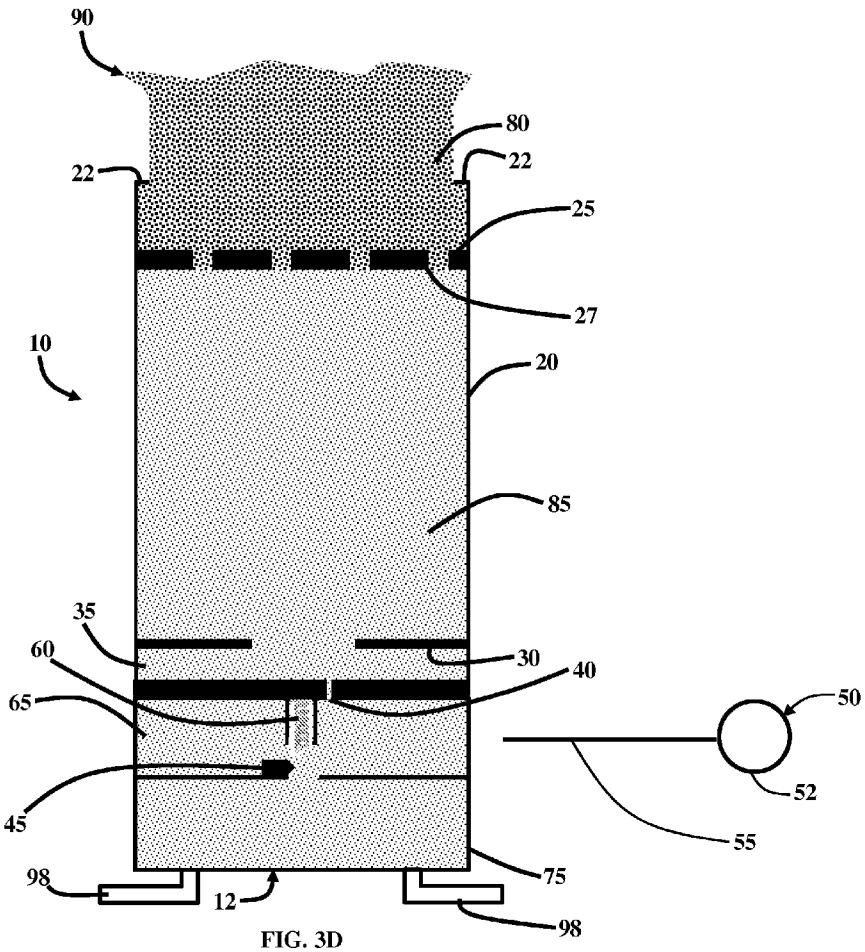
FIG. 3D illustrates a sectional view the compressed gas disseminator of FIG. 3A upon actuation according to another embodiment herein.

In addition, alternative embodiments may also include any material that is suitable for use in the construction of the non-pyrotechnic disseminator 10, and the type of disseminating materials being disseminated could include slurries and liquids in addition to or alternative to the powder 80 described above. Further embodiments, as shown in FIG. 3D, can include using a self-righting mechanism 98 operatively connected to the grenade body portion 12, such as spring actuated legs or a "roly poly" apparatus to increase the dissemination efficiency of the embodiments herein, by orienting the disseminator 10 so that the powder 80 (or slurry or liquid) will be disseminated into the air as opposed to parallel to the ground.

The disseminator 10 provided by the embodiments herein uses high pressure compressed gas 85 to rupture a disk 30 to instantaneously disseminate bulk powder 80 from the disseminator 10, with the turbulent flow of escaping high pressure gas 85 assisting with deagglomeration and particle breakup. The non-pyrotechnic powder disseminator 10 increases safety by eliminating fire and shrapnel hazards and reducing handling and storage restrictions.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A non-pyrotechnic disseminator, comprising:

a body portion;

a cover on said body portion;

a first compartment adjacent to said cover, wherein said first compartment is configured to hold disseminating materials;

a chamber adjacent to said first compartment opposite said cover;

a burst disk within said chamber and adjacent to said first compartment;

a flow control device adjacent to said chamber opposite said burst disk;

a second compartment adjacent to said flow control device, wherein said second compartment includes a stab pin;

an actuating mechanism comprising a safety pin which retains a spring operatively connected to said stab pin;

a third compartment adjacent to said second compartment opposite said flow control device, wherein said third compartment is configured to hold compressed gas; and a seal separating said third compartment ram said second compartment, and wherein when an operator removes the safety pin the stab pin is released and driven by the spring to puncture said seal releasing the compressed gas into the second compartment, and wherein said flow control device includes an orifice properly configured to meter the compressed gas flow from the second compartment into the chamber in order to provide a three to five second time delay before a burst pressure is reached and the burst disk ruptures thereby pushing said disseminating materials out of said body portion by rupturing said cover.

2. The non-pyrotechnic disseminator of claim 1, further comprising a piston in aid first compartment adjacent said burst disk.

3. The non-pyrotechnic disseminator of claim 2, wherein said piston includes holes so that the compressed air can deagglomerate said disseminating materials.

4. The non-pyrotechnic disseminator of claim 2, wherein said first compartment further comprises at least one stop configured to retain said piston within said first compartment when the disseminator is activated.

5. The non-pyrotechnic disseminator of claim 1, wherein said disseminating materials exit said body portion as an aerosol.

6. The non-pyrotechnic disseminator of claim 1, wherein said disseminating materials comprise any of a powder, slurry, and liquid.

7. The non-pyrotechnic disseminator of claim 1, further comprising a self-righting mechanism operatively connected to said body portion.

8. The non-pyrotechnic disseminator of claim 1, wherein said compressed gas comprises carbon dioxide.

* * * * *